US005649396A

United States Patent [19]

Carr

[11] Patent Number: 5,649,396

[45] Date of Patent: Jul. 22, 1997

[54] LOADING DOCK SAFETY BARRIER

[76] Inventor: Michael J. Carr, 1826 11 Mile Rd. NE., Comstock Park, Mich. 49321

[21] Appl. No.: 420,027

[22] Filed: Apr. 11, 1995

[51] Int. Cl.[6] ..... E01F 9/00

[52] U.S. Cl. ..... 52/174; 49/34

[58] Field of Search ..... 52/173.1, 174; 70/94; 292/259 R, 289, 290, 296–298, 338, 339; 14/50, 53; 49/9, 34

[56] References Cited

U.S. PATENT DOCUMENTS

| | | | |
|---|---|---|---|
| 2,088,046 | 7/1937 | White . | |
| 2,263,649 | 11/1941 | Sawyer . | |
| 2,668,052 | 2/1954 | Johnson . | |
| 2,675,197 | 4/1954 | Hospers . | |
| 2,702,953 | 3/1955 | Heinrich . | |
| 2,874,493 | 2/1959 | Mandel . | |
| 3,807,093 | 4/1974 | Tevis . | |
| 3,839,824 | 10/1974 | Ellis et al. . | |
| 3,952,453 | 4/1976 | Amburgey . | |
| 4,364,200 | 12/1982 | Cobb . | |
| 4,655,002 | 4/1987 | Everson . | |
| 4,770,495 | 9/1988 | Lees . | |
| 4,844,653 | 7/1989 | Dickinson . | |
| 4,897,960 | 2/1990 | Barvinek et al. . | |
| 4,923,327 | 5/1990 | Gorlov . | |
| 4,989,835 | 2/1991 | Hirsh . | |
| 5,010,747 | 4/1991 | Nordan, Jr. | 70/94 |
| 5,014,527 | 5/1991 | Traller et al. | 70/94 |
| 5,050,846 | 9/1991 | Goodman et al. . | |
| 5,364,140 | 11/1994 | Rile | 292/259 R |

*Primary Examiner*—Creighton Smith

[57] ABSTRACT

A semaphore type loading dock safety barrier for use across a vehicle passageway to prevent accidentally driving a vehicle off the end of the loading dock. A barrier mount is attached to a guidepost inside the loading dock doorway and is horizontally rotatable about a vertical axis. A rigid barrier arm is rotatably affixed to the barrier mount so that the barrier arm raises and lowers vertically in a semaphore arm fashion. The barrier arm is typically constructed from an I-beam or box beam and is of sufficient strength to resist vehicle impact. A receiving rest is attached to an opposite guidepost inside the loading dock doorway and is horizontally rotatable about a vertical axis and positioned to receive the free end of the barrier arm. The receiving rest has locking means on the receiving rest to lock the free end of the barrier arm in the receiving rest so that upon vehicle impact with the barrier arm deformation of the barrier arm and rotation of the barrier mount and receiving rest about their respective vertical rotation axes occurs while retaining the barrier arm in a locked relationship with the receiving rest.

20 Claims, 6 Drawing Sheets

LOADING DOCK SAFETY BARRIER

BACKGROUND OF THE INVENTION

This invention relates to safety barriers to prevent vehicles such as fork lifts from inadvertently driving off the end of truck or railroad loading docks.

Loading docks are typically found in many businesses and warehouses. A loading dock is usually a platform approximately four feet above ground level thereby permitting trucks to back up to the loading dock and to have a level surface on which to walk into the truck or to drive a fork lift onto the truck for loading or unloading purposes. Loading docks are usually open to the outside with a large vertically moveable door which is used to open and close access between the loading dock and the building. Interior to the door are guideposts which are located at either side of the door frame. The purpose of the guideposts is to prevent striking of the door frames by fork lifts while loading and unloading the trucks. These guideposts are typically circular in nature and approximately three to four feet in height. They are designed and constructed to withstand impacts from the fork lifts. While the door may be closed the majority of the time the loading dock is not in use, the doors may be opened for ventilation in warm weather, while trucks are being changed at the loading docks, or for other reasons.

Open doors on the loading docks present safety hazards. Personnel may inadvertently walk through the door and step off the edge of the dock or fork lifts, while maneuvering in the warehouse, may inadvertently back or drive out of the door. Limited visibility from the fork lift create a situation where it is difficult for the fork lift driver to discern the edge of the loading dock. Consequently, there is great risk of the fork lift being driven or backed off the edge of an empty loading dock. This situation has resulted in severe injuries to and even accidental death of the fork lift driver. Thus, it is desirable to install a safety barrier across the door to prevent such accidents from happening. For the barrier to be effective, it should be durable and strong enough to prevent a fork lift from breaking through and driving off the loading dock. The barrier should be easy to operate so that a minimal amount of time and effort is required to open and close the barrier. In the event of an impact with the barrier by a fork lift or similar vehicle, the barrier should sustain minimal damage so that it may be repaired quickly and inexpensively. The barrier should also incorporate a design to prevent blockage of the loading dock doorway so as not to hamper or interfere with the loading or unloading of trucks and the use of the loading dock. The barrier should also be able to be retrofitted into existing doorways utilizing current building structures on which to mount the barrier, thus minimizing the amount of building modifications necessary to incorporate the barrier.

It is an object of this invention to provide a safety barrier for use in existing warehouses which is readily attachable to the guideposts on either side of the loading dock doorway. The safety barrier mounts are attached to the guideposts in a horizontally rotatable fashion with a rigid barrier arm extending between the mounts. The barrier arm is pivotal at one end with the opposite free end raised for access to the loading dock and lowered into locking engagement with the other mount to block the vehicle passageway. It is a further object of this invention to incorporate a locking mechanism at the free end of the barrier arm such that when the free end of the barrier is engaged in the mount, that the barrier arm is retained by the mounts in the event a vehicle should impact the barrier. It is another object of this invention to provide a safety barrier which upon being impacted by a vehicle will result only in damage or deformation to the barrier arm and not to the remainder of the safety barrier, thus minimizing the number of parts required to be replaced to return the safety barrier to a functional status.

SUMMARY OF THE INVENTION

The present invention is a safety barrier for use at business and warehouse truck loading docks in order to prevent people or vehicles from falling or driving off an empty dock. The safety barrier is a vertically rotatable type barrier which operates in the manner of a conventional semaphore gate. The barrier is rotatably mountable to existing guideposts near the loading dock doorway and is comprised of a barrier mount affixed to one guidepost in a horizontally rotatable manner. A counter-balanced barrier arm is mounted to the barrier mount such that it rotates vertically to move the barrier arm up and out of the loading dock doorway to provide access to a truck at the loading dock. The barrier mount has a limit bar to limit the upward travel of the barrier arm and a spring biased lock to prevent the barrier arm from inadvertently descending into the loading dock area and either striking personnel or blocking access to the dock.

The barrier arm is a rigid beam which may be either an I-beam or a box-beam. When closed the free end of the barrier arm is engaged by a receiving mount affixed to the guidepost at the opposite side of the loading dock doorway.

The receiving mount has a locking mechanism to lock the free end of the barrier arm in the receiving mount when the barrier arm is in a substantially horizontal position. The locking mechanism engages both sides of the beam and is readily releasable to allow easy releasing of the barrier arm from the closed position. However, the locking mechanism will not disengage from the barrier arm in the event the barrier arm is struck by a fork lift or similar vehicle.

When the barrier arm is down in a substantially horizontal position and locked in the receiving mount the safety barrier is in its effective position. In the event a vehicle strikes the barrier, the barrier arm will prevent the vehicle from exiting the loading dock doorway. The barrier arm is rigid and can withstand small impacts with no damage occurring. Upon experiencing a significant impact, the barrier arm may yield and deform in a substantially horizontally plane but will not be released by either mount. As the barrier arm deforms in the direction of the loading dock doorway, the mounts rotate horizontally about the vertical axis of the guideposts until the vehicle movement is arrested. An attractive feature of this safety barrier is that in the event of an accident only the barrier arm requires replacing, unlike other safety barriers which employ frangible elements and require replacement of a significant number of individual elements in the barrier. Thus, the barrier is readily and easily repaired to resume service with minimal interruption to the surrounding activities.

The foregoing and various other objects and features of this invention will be apparent and fully understood from the following detailed description of the typical preferred form and application thereof. Throughout which description references made to the accompanying drawings.

DESCRIPTION OF THE PREFERRED EMBODIMENT

Figure 2:
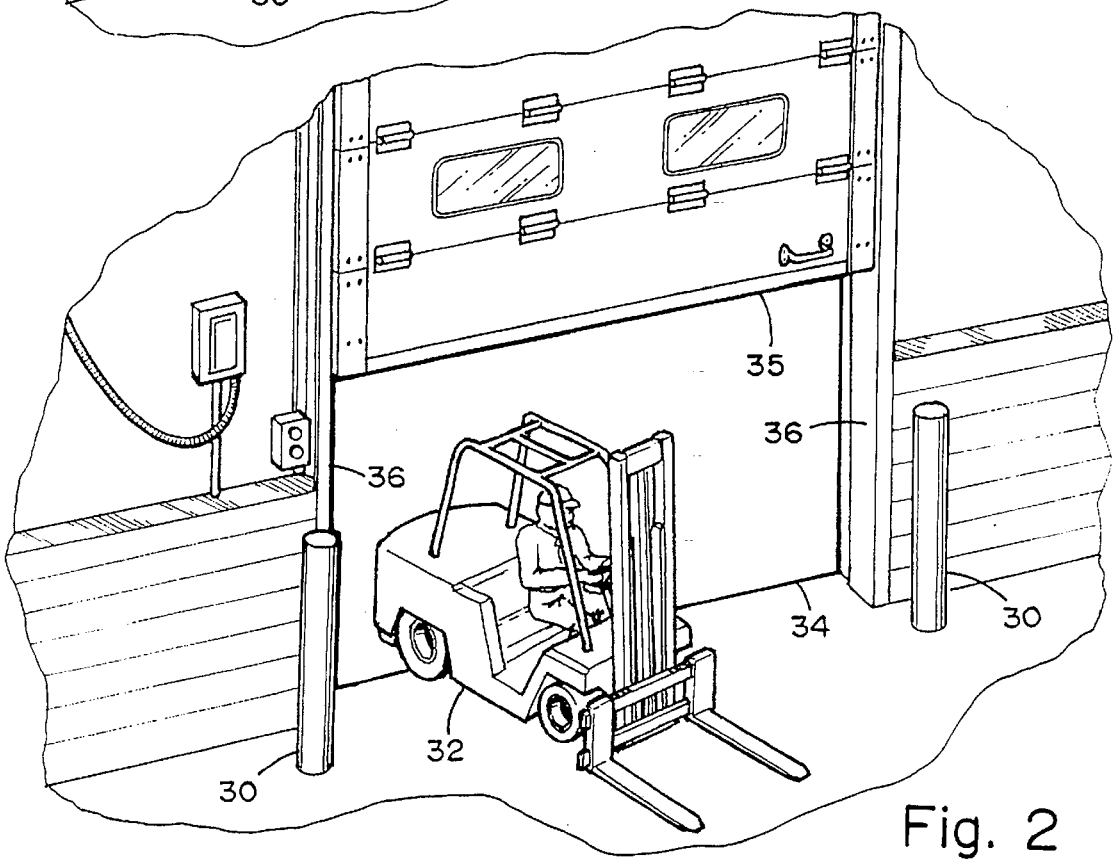
FIG. 2 is perspective view of a loading dock without a safety barrier and the resulting hazard of a vehicle accidentally driving off the end of the dock.

Referring to FIG. 2, a loading dock 34 for use with trucks, railroad cars or the like possesses an inherent safety hazard when the loading dock access door 35 is in the raised position. The loading dock 34 is approximately four feet above the adjacent ground level to permit transporting vehicles to be placed in proximity with the loading dock 34 and have the interior surface of the transporting vehicle substantially in the same plane as the loading dock 34 to permit easy transfer of materials from the warehouse to the transporting vehicle. The loading dock access door 35 is often in the open position while transporting vehicles are repositioned at the loading dock access door 35 or for ventilation purposes. There are no barriers across the access door 35 opening. The only existing safety barriers are vertical guideposts 30 inside the warehouse and at either side of the access door 35 to prevent a loading vehicle 32 such as a forklift from striking the sides 36 of the access door 35. While the access door 35 is in the open position and no transporting vehicle is positioned at the loading dock 34, there is a safety hazard of the loading vehicle 32 accidentally driving or backing off the edge of the loading dock 34 and severely injuring the driver of the loading vehicle 32 or a bystander.

Figure 1:
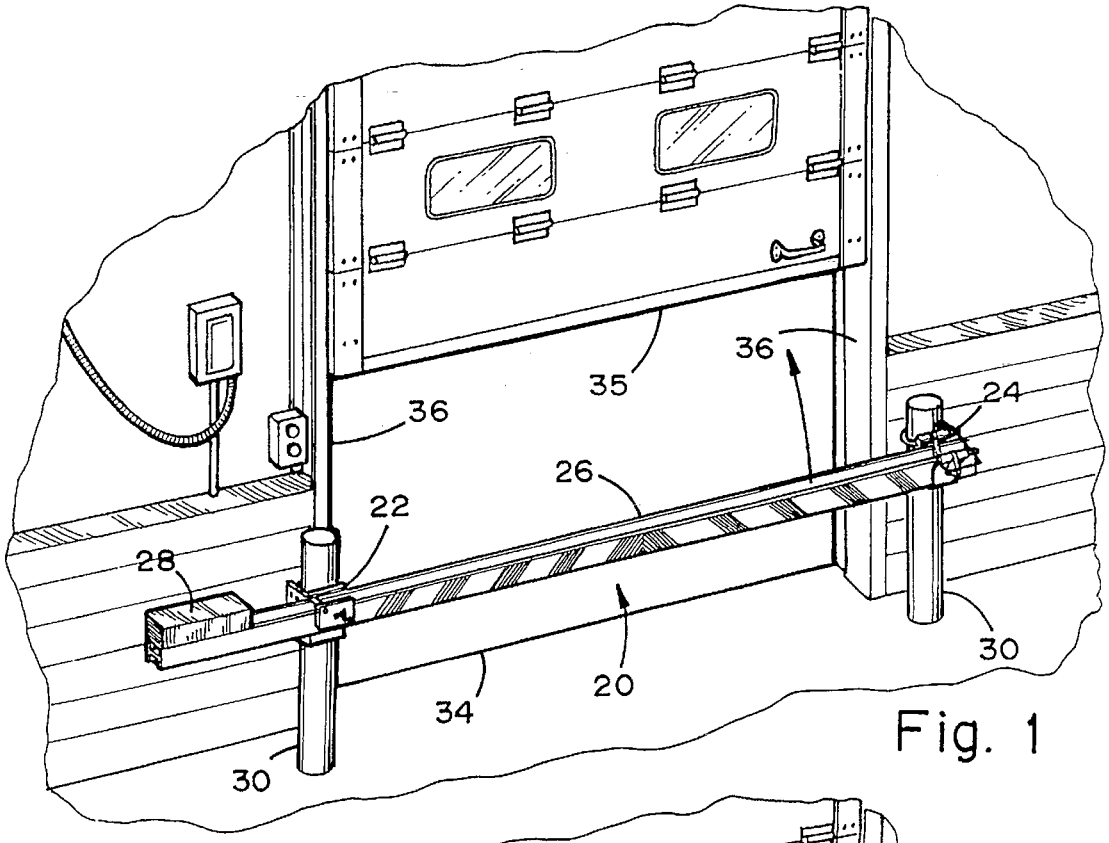
FIG. 1 is a perspective view of the loading dock safety barrier attached to guide posts inside a loading dock vehicle passageway.

Referring to FIG. 1, a loading dock safety barrier generally indicated at 20 has a barrier mount 22 affixed to a guidepost 30 at one side of the loading dock access door 35 and a receiving rest 24 affixed to a second guidepost 30 at the other side of the loading dock access door 35. A barrier arm 26 extends from the barrier mount 22 to the receiving rest 24 to prevent vehicles from accidentally passing through the loading dock access door 35 and driving off the loading dock edge 34 when a truck or railroad car is not positioned at the loading dock. The barrier arm 26 raises and lowers in a semaphore fashion, being pivoted at the barrier mount 22. A counter-balance weight 28 may be added to the end of the barrier arm to assist in raising and lowering the barrier arm 26. The counter-balance weight 28 is attached to the barrier arm 26 in a manner to make the barrier arm 26 marginally rotationally biased to the closed or engaged position as shown in FIG. 1.

Figure 3:
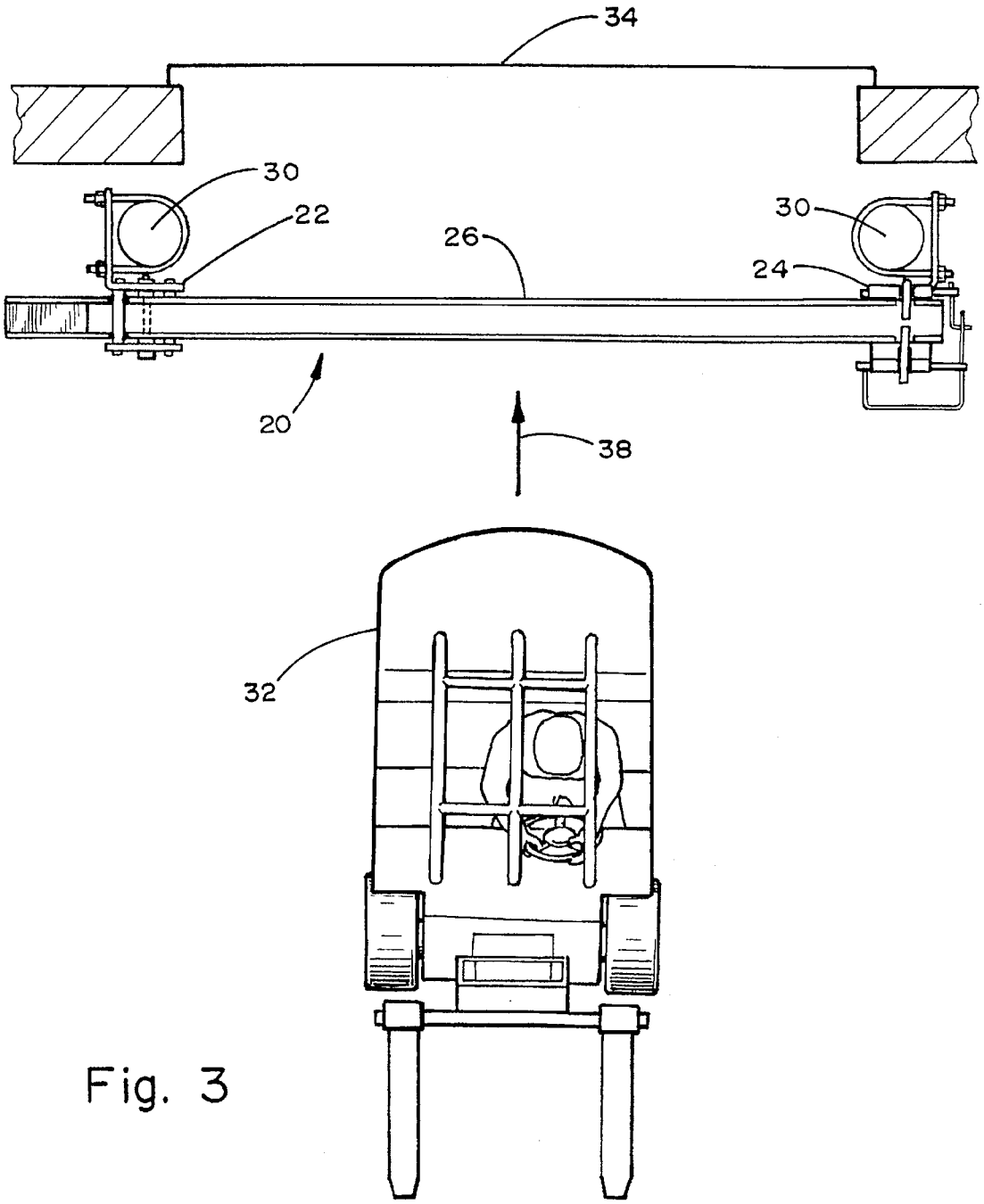
FIG. 3 is a top view showing the invention installed on guideposts on a loading dock and a vehicle approaching the barrier.
Figure 4:
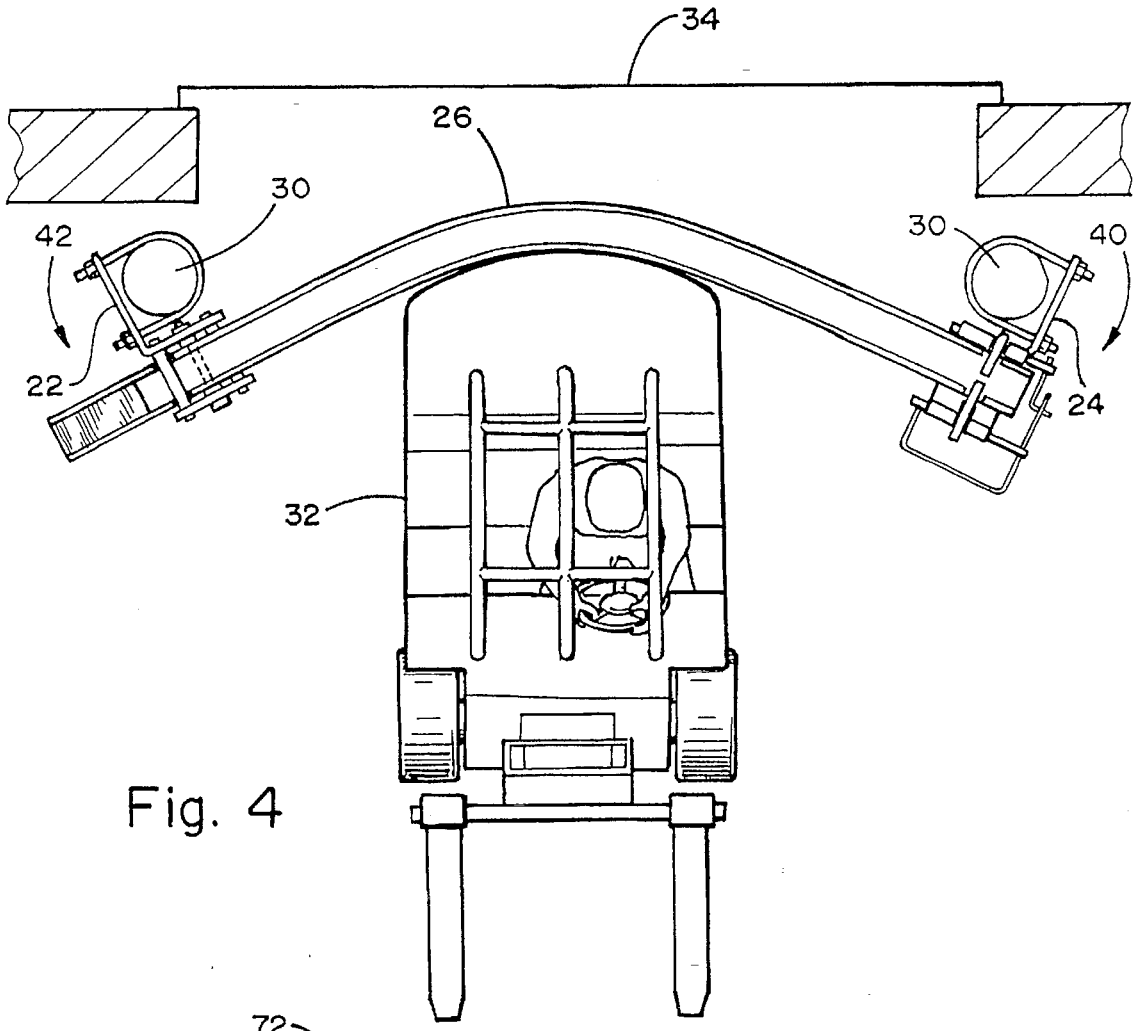
FIG. 4 is a top view showing a vehicle impacting the barrier and the resulting deformation of the barrier arm and the rotation of the mounts about the guideposts.

FIG. 3 shows a top view of a loading vehicle 32 traveling in the direction 28 of the loading dock 34 with the safety barrier 20 installed on the guideposts 30. If the loading vehicle 32 does not stop and subsequently impacts the safety barrier 20 as shown in FIG. 4, the dynamics and strength of the safety barrier 20 prevent the loading vehicle 32 from driving off the edge of the loading dock 34. When the loading vehicle 32 impacts the safety barrier 20, the vehicle 32 contacts the barrier arm 26, which because of the elastic and ductile properties of the barrier arm 26 deforms and absorbs the energy of the moving vehicle 32 until the movement of the vehicle 32 is arrested prior to driving off the edge of the loading dock 34. The barrier arm 26 is locked into and retained by the barrier mount 22 and the receiving rest 24 in a manner described later. As the barrier arm deforms in the direction of travel 28 of the vehicle 32, horizontal rotational moments are induced in the barrier mount 22 and the receiving rest 24. The barrier mount 22 and the receiving rest 24 are rotationally displaced about the vertical axes of guideposts 30 in a clockwise and counter-clockwise manner as shown by rotational directions 40 and 42. This rotational displacement prevents damage occurring to the barrier mount 22 and the receiving rest 24.

Figure 5:
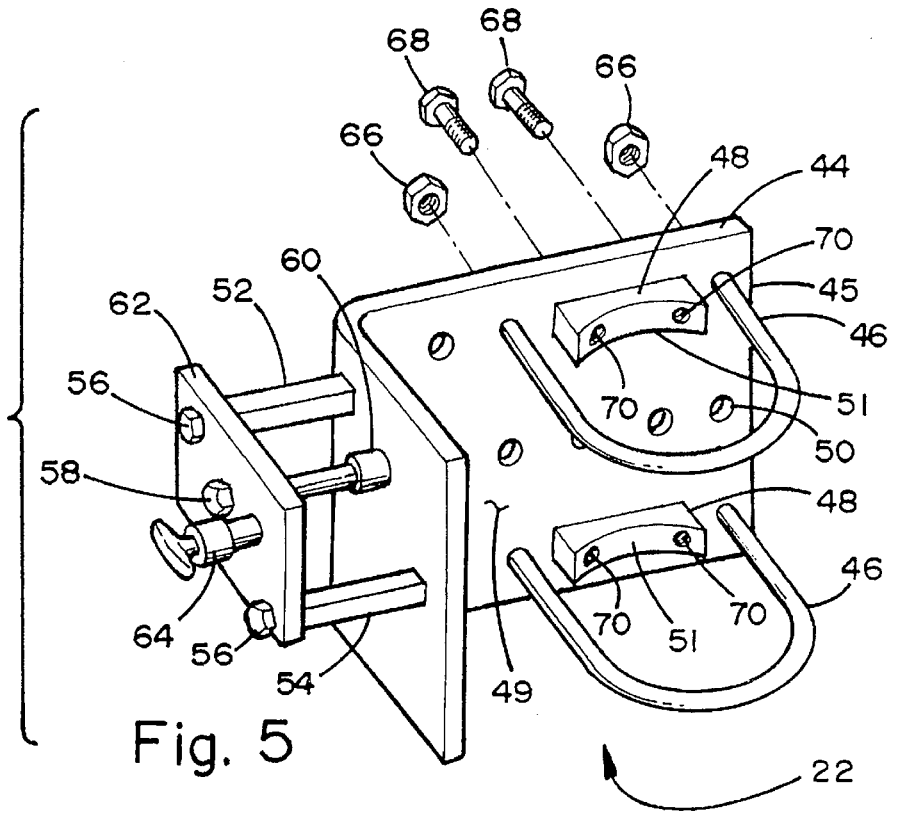
FIG. 5 is a perspective view of the barrier mount.

A detailed view of the barrier mount 22 is shown in FIG. 5. The barrier mount 22 is comprised of an L-shaped barrier mount bracket 44. The long leg 45 of the bracket 44 has a pattern of holes 50 to permit the attachment of the barrier mount 22 to a guidepost 30. Two conformal blocks 48 are attached to the inner face 49 of the long leg 45 of the bracket 44 by means of bolts 68 inserted through the holes 50 and into threaded holes 70 in the conformal blocks 48. The purpose of the conformal blocks 48 is to provide a clamping and bearing surface 51 to mate to the guidepost 30. A U-bolt 46 is inserted through two additional holes 50 in substantially the same plane as and in an opposing direction to the conformal block 48. Nuts 66 are threaded onto the ends of the U-bolt, and as the nuts are torqued the U-bolt 66 and conformal block are spatially drawn together and provide a clamping force on the guidepost 30. The generated clamping force retains the barrier mount 22 in its desired position on the guidepost 30 while still permitting the horizontal rotation of the barrier mount 22 about the guidepost 30.

Referring further to FIG. 5, a retaining plate 62 is attached to the short leg 47 of the barrier mount bracket 44. The retaining plate is held in substantially a parallel spatial relationship to the short leg 47 of the barrier mount bracket 44. The retaining plate 62 is separated from the barrier mount bracket by limit bar 52 and engagement bar 54. A bolt 56 is passed through the retaining plate 62 and longitudinally through the limit bar 52. The bolt is either threaded and torqued into a mating threaded hole in the short leg of the barrier mount bracket 44. Alternatively the bolt may protrude through a hole in the short leg 47 and have a nut torqued onto the threaded end of the bolt. In similar fashion a bolt 56 is also passed through the retaining plate 62, longitudinally through the engagement bar 54 and the short leg 47 and is then torqued in place. An up-lock 64 is also installed in the retaining plate 62 and is described in further detail below. The space between the retaining plate 62 and the short leg 47 is slightly larger than the width of the barrier arm 26 to permit free rotational movement of the barrier arm 26.

The barrier arm 26 is placed between the retaining plate 62 and the short leg 47 and between the limit bar 52 and engagement bar 54. A pivot bolt 58 is inserted through the retaining plate 62 and, referring to FIG. 8, through the pivot hole 126 in the barrier arm 26. The pivot bolt 58 also passes through a pivot spacer 60 prior to passing through the short leg 47 of the barrier mount bracket 44 and is then threaded and torqued into a mating threaded hole in the short leg of the barrier mount bracket 44. Alternatively the bolt may protrude through a hole in the short leg 47 and have a nut torqued onto the threaded end of the bolt. The pivot spacer 60 provides separation of the barrier arm 26 from the barrier mount bracket 44 and prevents the lateral movement of the barrier arm 26 on the pivot bolt.

Figure 9:
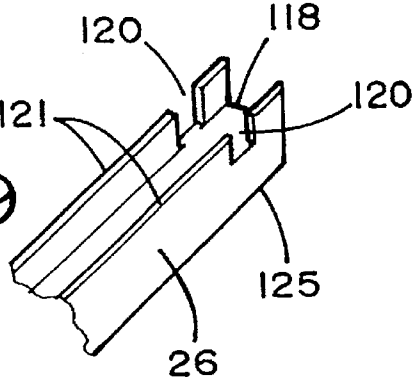
FIG. 9 is a perspective view of the end of the barrier arm.
Figure 8:
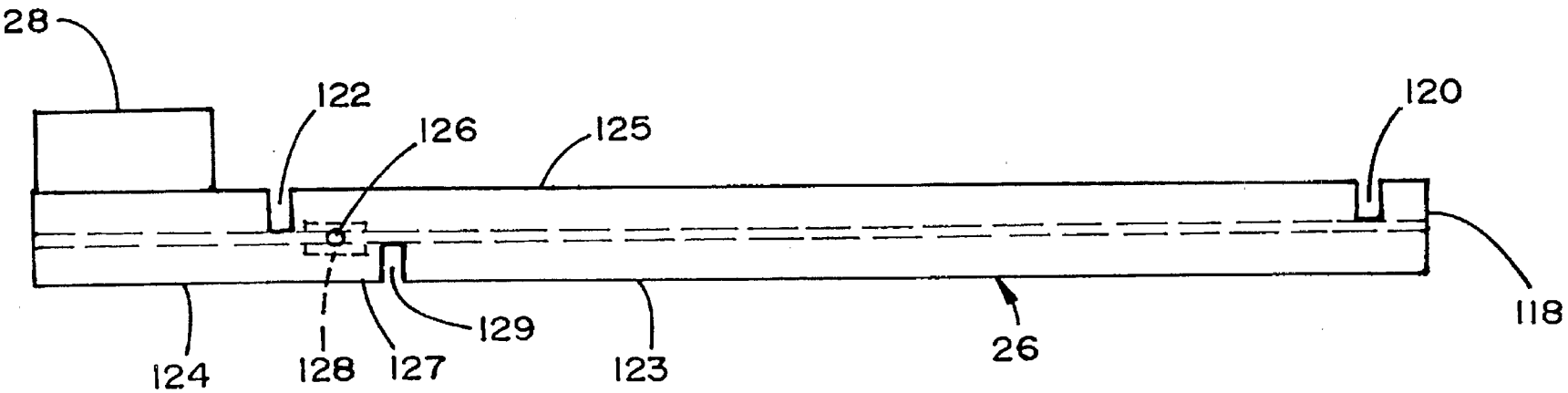
FIG. 8 is a front view of the barrier arm.

FIG. 8 shows the preferred configuration of the barrier arm 26. The barrier arm 26 has a free end 118 and a pivot end 124. The pivot end 124 of the barrier arm 26 is affixed to the barrier mount 22 as described above. The barrier arm 26 as shown is fabricated from an I-beam. However, the barrier arm 26 may also be fabricated from a box-beam, U-beam, or some other cross-sectional geometry, and the unique features of the barrier arm 26 may be incorporated in any of these beam configurations. The material from which the barrier arm 26 is fabricated is ideally of aluminum because of aluminum's favorable strength to weight ratio, its ductility, and low cost. Other high strength ductile materials may also be substituted for aluminum without materially affecting the performance of the invention. Referring to FIG. 9, proximate to the barrier arm free end 118, locking notches 120 are formed in the upper flanges 121 of the barrier arm 26. The locking notches 120 are engaged by locking dogs 74 and 76 in FIG. 6 which are discussed in further detail below. Engagement notches 122 and 129 are formed in the upper and lower flanges 121 and 123, respectively, of the barrier arm 26. The notches 129 and 122 are respectively located slightly toward and slightly away from the free end 118 from the pivot hole 126, corresponding in dimension to the lateral separation of the pivot bolt 58 and the engagement bar 54 and 52 respectively. As the barrier arm is rotated into its lowered position the notches 122 and 129 fit over the engagement bars 52 and 54, thereby providing retention of the barrier arm in the barrier mount 22 upon impact of a vehicle 32 with the barrier 20. The pivot end 124 of the barrier arm extends beyond the barrier mount 22 a sufficient length to permit the attachment of a counter-balance weight 28. The counterbalance weight 28 is fabricated to counter the weight of the barrier arm 26 thereby providing ease of operation of the barrier arm 26. The weight 28 is such that the barrier arm 26 is marginally weighted in favor of rotation of the barrier arm to the lowered horizontal position in engagement with the receiving rest 24. The weight 28 may be attached to the barrier arm 26 in any fashion providing a solid and secure attachment.

If the barrier arm 26 is raised too quickly, the upper surface 125 of the barrier arm 26 will strike the limit bar 52 and ricochet back to a horizontal position. If the operator is not aware of this potential, he or she could be struck by the barrier arm 26 as it rotates back to its horizontal position. To prevent this an up-lock 64 is installed on the retaining plate 62.

Figure 11:
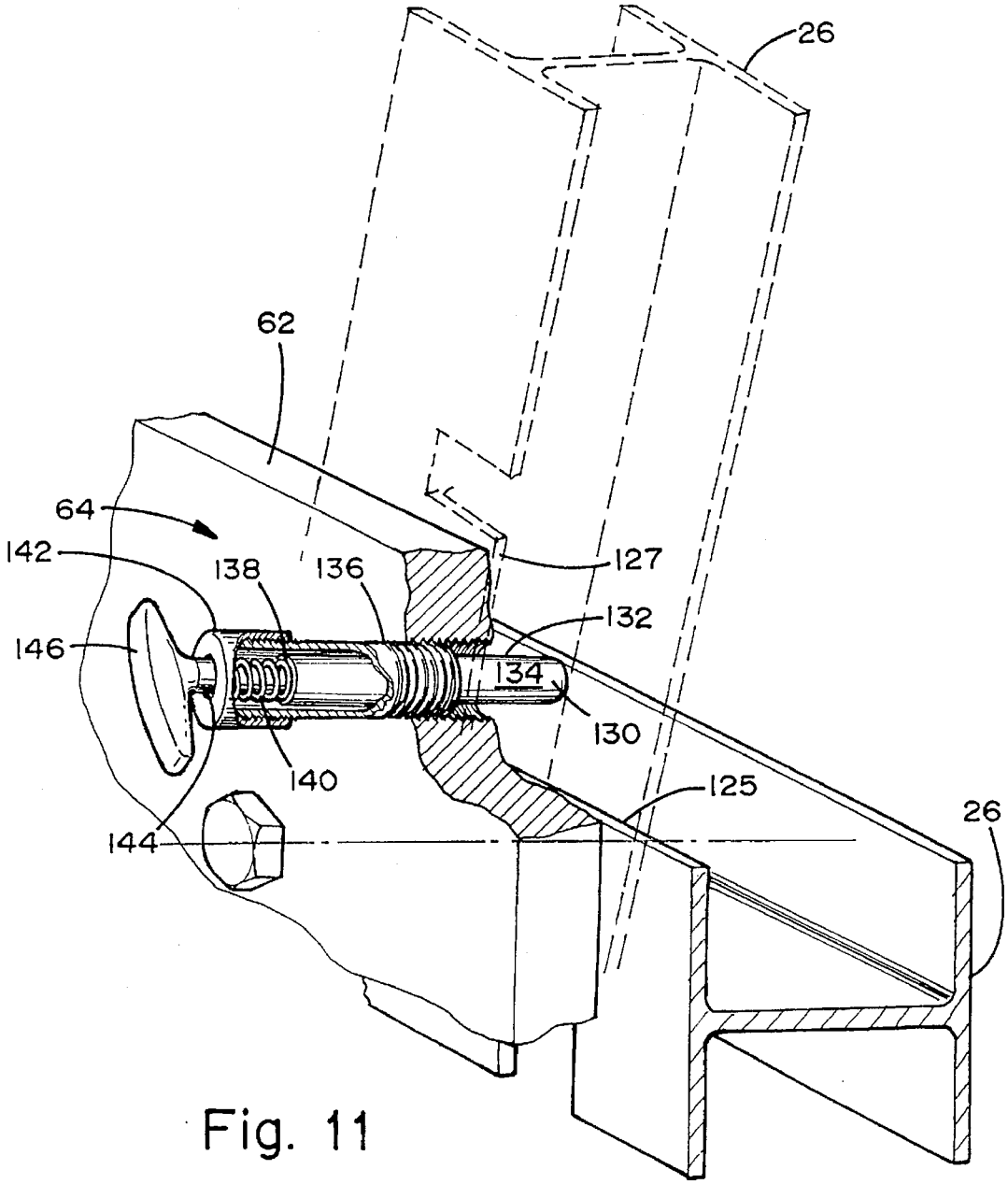
FIG. 11 is a sectional view of the spring biased up-lock.

Referring to FIG. 11, a pin barrel 136 threaded at both ends is threaded into the retaining plate 62 and is positioned on the retaining plate 62 to maintain the barrier arm in a raised position so as not to block the loading dock doorway 35. The pin barrel 136 is further positioned on the retaining plate 62 to be above the barrier arm 26 when the barrier arm 26 is in its closed and engaged position. A locking pin 134 extends through the pin barrel. A outer end 130 of the locking pin 134 extends through the pin barrel 136 and the retaining plate 62 and into the plane of the barrier arm flange 121. On the opposite end of the locking pin 134 from the outer end 130 is a shouldered area 138 of the locking pin. At the shoulder 138, the locking pin diameter decreases to form the shaft 144. A compression type biasing spring 140 is inserted on the shaft 144. A retaining cover 142 is threaded on the pin barrel 136, compressing the bias spring 140, and biasing the locking pin 134 into the plane of the barrier arm flange 121. A handle 146 is attached to the shaft 144 to permit manual operation of the locking pin 134.

To raise the barrier arm 26, pin 134 is retracted and then barrier arm 26 is raised past the pin. The pin is then released, and the locking pin 134 is once again projected into the path of the barrier arm 26 by the biasing spring 140. A lower surface 127 of the barrier arm 26 contacts a locking surface 132 of the locking pin 134. Because the locking surface 132 is substantially perpendicular to the lower surface 127, the locking pin 134 retains the barrier arm 26 in its raised position. When the barrier arm 26 is desired to be lowered, the operator pulls on the handle 146 to overcome the biasing force of spring 140 and thereby retract the locking pin 134 from the path of the barrier arm 26 permitting the barrier arm to rotate to its horizontal position.

Figure 6:
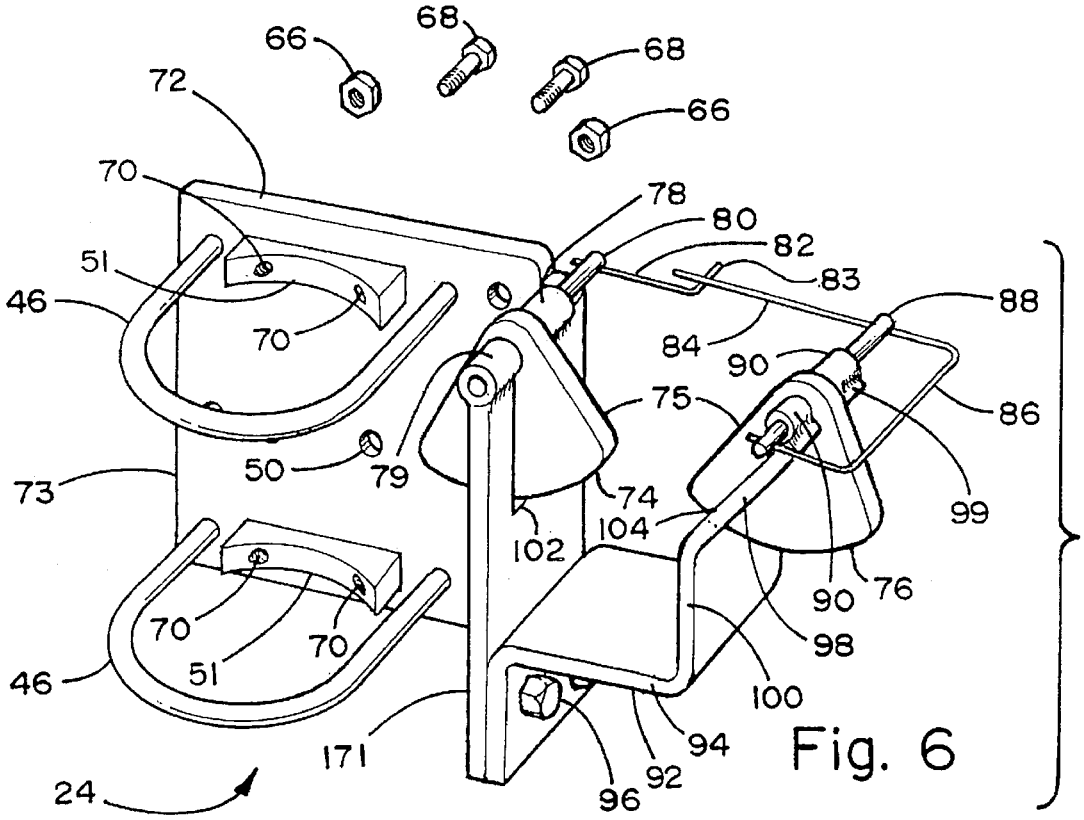
FIG. 6 is a perspective view of the receiving rest.

As the barrier arm 26 rotates to its horizontal position it comes in proximity to and engages the receiving rest 24. Receiving rest 24 is located on the opposite guidepost from barrier mount 22 and in substantially the same vertical plane as barrier mount 22. A detailed view of the receiving rest 24 is shown in FIG. 6. The receiving rest 24 is comprised of an L-shaped receiving rest bracket 72. The long leg 73 of the bracket 72 has a pattern of holes 50, conformal blocks 48, and U-bolts 46 to permit the attachment of the receiving rest 24 to a guidepost 30 in the same manner as the barrier mount 22 is attached to the guidepost 30.

The short leg 71 of the receiving rest bracket 72 has a segmented hinge 78 welded to its upper surface 79. A slot 102 is cut into and extends vertically downward from the upper surface 79 into the short leg 71. A first locking dog 74 is positioned in the slot 102 and a hinge pin 80 is inserted through the segmented hinge 78 and the locking dog 74. The hinge pin 80 is fixedly attached to the locking dog 74 such that rotation of the hinge pin 80 will cause the locking dog 74 to rotate correspondingly. The locking dog 74 has an actuating surface 75 which extends angularly from the proximity of the hinge pin 80 and through the plane of the barrier arm flange 121 when the barrier arm 26 is engaged in the receiving rest 24. The mass of the locking dog 74 is concentrated below the hinge pin 180 so that as the locking dog 74 is rotated gravity will act on the locking dog 74 to return it to its position of passing through the plane of the barrier arm flange 121.

A receiving bracket 92 is attached to the short leg 71 by bolts 96 passing through the short leg 71 and bracket 92 and then torqued to produce a clamping force. The bracket 92 has a horizontal rest 94 on which the barrier arm 26 rests when engaged in the receiving rest 24. The horizontal rest 94 extends away from the short leg 71 a distance large enough to accommodate the width of the barrier arm 26. A vertical flange 100 extends upward from the horizontal rest 94 substantially parallel to the short leg 71 before flaring out away from the short leg 71 in an angled manner to form a guide flange 98. The guide flange 98 directs the barrier arm 26 into an engagement position with the receiving rest 24. A second segmented hinge 90 is welded to the upper surface 99 of the guide flange 98. A slot 104 is cut into and extends vertically downward from the upper surface 99 into the guide flange 98 in a manner similar to and laterally opposite from the slot 102 in short leg 71. A hinge pin 88 and second locking dog 76 are installed in the hinge 90 and slot 104 in a manner similar to the hinge 80 and locking dog 74. The second locking dog 76 is similar in configuration to locking dog 74 and operates in the same manner.

As the barrier arm 26 is lowered to the receiving rest 24, the barrier arm lower surfaces 125 contact the actuating surfaces 75 of the locking dogs 74 and 76. The downward movement of the barrier arm 26 rotationally displaces the locking dogs 74 and 76 to allow the barrier arm to engage in the receiving rest 24. When the barrier arm 26 reaches its full down position, the locking notches 120 on the barrier arm 26 are in alignment with the locking dogs 74 and 76. The locking dogs 74 and 76 are then free to rotate by force of gravity to their engaged position, thus locking the free end 118 of the barrier arm 26 in the receiving rest 24. Upon impact of a vehicle 32 with the barrier arm 26 the locking dogs 74 and 76 remain in engagement with the barrier arm 26 to prevent the withdrawal of the barrier arm 26 from the receiving rest and also to impart the rotational moment to the receiving rest 24 about the vertical axis of the guidepost 20.

To disengage the locking dogs 74 and 76, the operator lifts the actuating handle 86 to impart a rotational moment to the hinge pin 88. The rotational moment applied to the hinge pin 88 rotates the locking dog 76 out of engagement with the locking notch 120 in the barrier arm 26. An actuating lever extends through the end of hinge pin 88 toward receiving rest bracket 72. A second actuating lever extends through the hinge pin 80 toward the guide flange 98 and terminates in an engagement arm 83. The actuating arm overlaps the engagement arm 83 so that when the actuating handle is lifted to disengage the locking dog 76, a rotational moment is induced in the hinge pin 80 by the actuating arms and correspondingly rotates the locking dog 74 out of engagement with the locking notch 120 on the opposite side of the barrier arm 26. The barrier arm may now be lifted and rotated in semaphore fashion out of the loading dock passageway.

Figure 7:
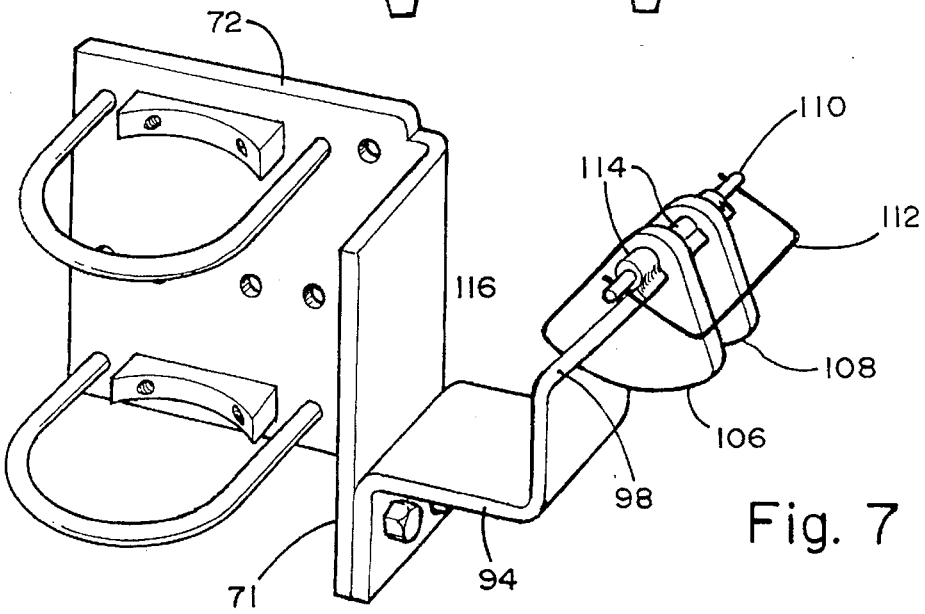
FIG. 7 is a perspective view of an alternate configuration for the receiving rest.
Figure 10:
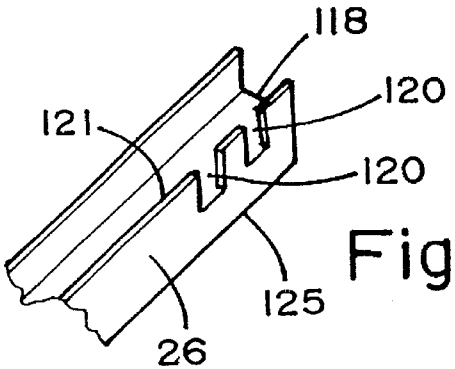
FIG. 10 is a perspective view of an alternate configuration of the end of the barrier arm.

An alternate configuration for the receiving rest is shown in FIG. 7. In this configuration there are two locking dogs 106 and 108 which are located on the guide flange 98. However, there are not locking dogs located on the short leg 71 of bracket 72. A multi-segmented hinge 114 is attached to the guide flange 98 in the same manner as in FIG. 6. A handle 112 is affixed to hinge pin 110 to provide rotational force to disengage the locking dogs 106 and 108. This alternate receiving rest 24 configuration also requires an alternate configuration for the free end 118 of the barrier arm 26. This alternate configuration is shown in FIG. 10. In this barrier arm 26 configuration, both locking notches 120 are located on one barrier arm flange 121 to positionally correspond to the locking dogs 106 and 108.

The plate items of the barrier mount 22 and the receiving rest 24 are typically fabricated from ½ inch steel plate for strength purposes. However, any high strength formable material may be used without affecting the performance of the invention.

It should be understood that the foregoing represents a preferred embodiment of the present invention and that various changes may be made in this embodiment without departure from the spirit and scope of the invention, which is defined in the appended claims.

I claim:

1. A semaphore type vehicle safety barrier for use across a vehicle passageway comprising:

a barrier mount horizontally rotatable about a first vertical axis;

attachment means on the barrier mount to rotatably attach the barrier mount to a first vertical guidepost located at one side of the vehicle passageway;

a rigid barrier arm having a pivot end and a free end and vertically rotatable about a substantially horizontal lateral axis at the pivot end wherein the pivot end is rotatably affixed to the barrier mount, the barrier arm being of sufficient strength to resist vehicle impact;

a receiving rest horizontally rotatable about a second vertical axis positioned in substantially the same horizontal plane as the barrier mount and positioned to receive the free end of the barrier arm;

locking means on the receiving rest to lock the free end of the barrier arm in the receiving rest wherein vehicle impact with the barrier arm causes deformation of the barrier arm and rotation of the barrier mount about the first vertical axis and rotation of the receiving rest about the second vertical axis while retaining the barrier arm in a locked relationship with the receiving rest; and attachment means on the receiving rest to rotatably attach the receiving rest to a second vertical guidepost located at the other side of the vehicle passageway.

2. The vehicle barrier as set forth in claim 1 wherein the rigid barrier arm is one of an I-Beam, a Box-Beam, and a U-Beam.

3. The vehicle barrier as set forth in claim 1 wherein the pivoting end of the barrier arm extends substantially away from the vehicle passageway and further comprising:

a counter-balance weight attached to an extended end of the barrier arm such that the barrier arm is marginally weighted to rotate to a position of engagement with the receiving rest.

4. The vehicle barrier as set forth in claim 1 wherein a lower surface of the barrier arm has a notch extending laterally across the arm in proximity to its pivoting point on the barrier mount and further comprising;

an engagement bar affixed to the barrier mount and extending across a rotational path of the barrier arm, the engagement bar further engaging the barrier arm notch to apply rotational force to the barrier mount at vehicle impact with the barrier arm.

5. The vehicle barrier as set forth in claim 1 further comprising a limit bar affixed to the barrier mount and extending across a rotational path of the barrier arm to limit at least one of an upward and a downward rotation of the barrier arm.

6. The vehicle barrier as set forth in claim 4 further comprising:

an auto-engaging up-lock affixed to the barrier mount and engaging the barrier arm to maintain the barrier arm in a raised position wherein the up-lock will not disengage the barrier arm until manually released.

7. The vehicle barrier as set forth in claim 6 wherein the auto-engaging up-lock is spring biased in a locked position and raising of the barrier arm overcomes the spring bias until the barrier arm passes the up-lock and the biasing spring returns the up-lock to the locked position.

8. The vehicle barrier as set forth in claim 5 further comprising an up-lock that has a spring pin biased in a closed position to interfere with rotation of the barrier arm such that the spring pin extends into the rotational path of the barrier arm when the barrier arm is rotated up and past the spring pin.

9. The vehicle barrier as set forth in claim 7 wherein the locking means includes locking dogs located on a same side of the barrier arm.

10. The vehicle barrier as set forth in claim 7 wherein the locking means includes locking dogs located on opposite sides of the barrier arm.

11. A semaphore type vehicle safety barrier used across a vehicle passageway comprising:

a barrier mount horizontally rotatable about a first vertical axis;

attachment means on the barrier mount to rotatably attach the barrier mount to a first vertical guidepost located at one side of the vehicle passageway;

a rigid barrier arm having a pivot end and a free end and vertically rotatable about a substantially horizontal lateral axis at the pivot end wherein the pivot end is rotatably affixed to the barrier mount, the free end having one or more notches, and the barrier arm being of sufficient strength to resist vehicle impact without fracturing;

a receiving rest horizontally rotatable about a second vertical axis and positioned to receive the free end of the barrier arm;

locking dogs rotatably mounted on the receiving rest and freely movable to allow the free end of the barrier arm to displace the locking dogs from an original position and continue rotating into an engaged position in the receiving rest whereby the locking dogs freely rotate back to said original position engaging the notches in the free end of the barrier arm thereby locking the free end of the barrier arm in the receiving rest wherein vehicle impact with the barrier arm causes deformation of the barrier arm and rotation of the barrier mount about the first vertical axis and rotation of the receiving rest about the second vertical axis while retaining the barrier arm in a locked relationship with the receiving rest; and attachment means on the receiving rest to rotatably attach the receiving rest to a second vertical guidepost located at the other side of the vehicle passageway.

12. A safety barrier comprising:

a first support member and a second support member that are located at two opposing sides of a passageway;

a barrier mount rotatably connected with said first support member to rotate about a first vertical axis;

a barrier arm having a pivot end that is pivotally connected with said barrier mount to pivot said barrier arm between an open position and a closed position, and having an opposing free end;

a receiving rest rotatably connected with said second support member to rotate about a second vertical axis, said first and said second vertical axes being generally parallel, said free end of said barrier arm being releasably received by said receiving rest when said barrier arm is in said closed position, said receiving rest including a lock to lock said free end of said barrier arm in said receiving rest when said barrier arm is in said closed position, whereby an impact of predetermined magnitude, upon said barrier arm causes deformation of said barrier arm and rotation of at least one of said barrier mount and said receiving rest about its respective axis, with said barrier arm free end remaining locked in said receiving rest.

13. The safety barrier defined in claim 12 wherein said barrier arm is one of an I-beam, a box-beam, and a U-beam.

14. The safety barrier defined in claim 12 further including a counter balance, whereby said barrier arm is biased toward said closed position and is conveniently moveable by a user between said dosed and said open positions.

15. The safety barrier defined in claim 12 wherein said barrier mount further includes an engagement bar, and said pivot end of said barrier arm includes a cooperating engagement coupling, whereby said engagement bar and said engagement coupling connect said barrier mount with said barrier arm in locking engagement, to resist withdrawal of said barrier arm from said barrier mount when said impact of predetermined magnitude is applied to said barrier arm.

16. The safety barrier defined in claim 12 wherein said barrier mount further includes a limit member to limit pivotal rotation of said barrier arm between said open position and said closed position.

17. The safety barrier defined in claim 12 further including an up-lock that is connected between said barrier mount and said barrier arm to lock said barrier arm in said open position.

18. The safety barrier defined in claim 17 wherein said up-lock has a locked position and an unlocked position, and is biased toward said locked position, wherein said barrier arm holds said up-lock in said unlocked position when said barrier arm is in its closed position, and wherein said barrier arm releases said up-lock to said locked position when said barrier arm is in its open position.

19. The safety barrier defined in claim 12 wherein said receiving rest includes at least one locking dog that locks said free end of said barrier arm in said receiving rest, when said barrier arm is in said closed position.

20. The safety barrier defined in claim 19 wherein said receiving rest includes a first locking dog and a second locking dog, wherein said first locking dog is located on a first side of said receiving rest, and wherein said second locking dog is located on one of said first side of said receiving rest and a second, opposite side of said receiving,

* * * * *

UNITED STATES PATENT AND TRADEMARK OFFICE

CERTIFICATE OF CORRECTION

PATENT NO. : 5,649,396
DATED : July 22, 1997
INVENTOR(S) : Michael J. Carr

It is certified that error appears in the above-indentified patent and that said Letters Patent is hereby corrected as shown below:

Column 2, line 65:

insert --a-- after "is";

Column 7, line 67:

delete "positioned in substantially the same horizontal plane as the barrier mount";

Column 10, line 11:

"dosed" should be --closed--.

Signed and Sealed this

Twenty-eighth Day of October, 1997

*Attest:*

Bruce Lehman

BRUCE LEHMAN

*Attesting Officer*

*Commissioner of Patents and Trademarks*